US010480845B2

(12) United States Patent
Yang

(10) Patent No.: US 10,480,845 B2
(45) Date of Patent: Nov. 19, 2019

(54) ICE-MAKING DEVICE FOR REFRIGERATOR

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 93 days.

(21) Appl. No.: 15/465,201

(22) Filed: Mar. 21, 2017

(65) Prior Publication Data

US 2017/0292749 A1 Oct. 12, 2017

(30) Foreign Application Priority Data

Apr. 8, 2016 (KR) ..... 10-2016-0043474

(51) Int. Cl.

| | |
|---|---|
| ***F25C 1/22*** | (2018.01) |
| ***F25C 5/18*** | (2018.01) |
| ***F25C 1/24*** | (2018.01) |
| ***F25C 5/182*** | (2018.01) |
| ***F25C 1/25*** | (2018.01) |

(52) U.S. Cl.

CPC ..... *F25C 5/182* (2013.01); *F25C 1/24* (2013.01); *F25C 1/25* (2018.01); *F25C 2400/10* (2013.01); *F25C 2400/14* (2013.01)

(58) Field of Classification Search

CPC ..... F25C 1/25; F25C 2400/14

See application file for complete search history.

(56) References Cited

U.S. PATENT DOCUMENTS

| | | | | |
|---|---|---|---|---|
| 8,534,089 | B2 | 9/2013 | An et al. | |
| 2008/0092574 | A1 | 4/2008 | Doberstein | |
| 2014/0182325 | A1 | 7/2014 | Lee et al. | |
| 2016/0003514 | A1* | 1/2016 | Ji | F25C 5/08 62/351 |

FOREIGN PATENT DOCUMENTS

| | | | |
|---|---|---|---|
| DE | 102009046034 | A1 | 5/2011 |
| EP | 1653171 | A2 | 5/2006 |
| EP | 2341303 | A2 | 7/2011 |

(Continued)

OTHER PUBLICATIONS

Extended European Search Report dated Jul. 31, 2017 issued in corresponding European Patent Application No. 17165516.0.

*Primary Examiner* — Christopher R Zerphey

(57) ABSTRACT

An ice-making device in a refrigerator including water blocking walls configured to prevent water supplied to an ice tray from straying outside the ice tray. The ice-making device includes an upper frame and a lower frame. A water supply port is disposed in a rear wall of the upper frame and configured to supply water to an ice tray between the upper frame and the lower frame. An upper sidewall protrudes downward from the upper frame. A main water-blocking rib protrudes from the rear wall and configured to prevent water supplied from the water supply port from straying along the upper sidewall. An auxiliary water-blocking rib protrudes from the upper sidewall and can further prevent the water supplied from the water supply port from straying along the upper sidewall.

15 Claims, 5 Drawing Sheets

(56) References Cited

FOREIGN PATENT DOCUMENTS

| | | | |
|---|---|---|---|
| EP | 2610563 | A2 | 7/2013 |
| JP | S59-009272 | U | 1/1984 |
| JP | 2011-069590 | | 4/2011 |
| KR | 10-2007-0077672 | A | 7/2007 |
| KR | 10-2010-0034477 | A | 4/2010 |
| KR | 10-2010-0064536 | A | 6/2010 |
| KR | 20-2013-0001691 | U | 3/2013 |
| KR | 10-1519877 | B1 | 5/2015 |
| WO | 2008/056918 | A1 | 5/2008 |
| WO | 2009/057891 | A2 | 5/2009 |

* cited by examiner

ICE-MAKING DEVICE FOR REFRIGERATOR

CROSS-REFERENCE TO RELATED APPLICATION

This application is based on and claims priority from Korean Patent Application No. 10-2016-0043474, filed on Apr. 8, 2016, the disclosure of which is incorporated herein in its entirety by reference for all purposes.

TECHNICAL FIELD

Embodiments of the present disclosure relate to ice-making devices in refrigerators.

BACKGROUND

A refrigerator is an appliance for use in storing food at a low temperature and may be configured to store food (or other items) in a frozen state or a refrigerated state. The inside of the refrigerator is cooled by circulating cold air that can be continuously generated through a heat exchange process by using a refrigerant. During operation, the refrigerant goes through repetitive cycles of compression, condensation, expansion and evaporation. The cold air supplied into the refrigerator is uniformly distributed by convection. Accordingly, the items placed in the refrigerator can be stored at a desired low temperature.

A main body of the refrigerator may have a rectangular parallel-piped shape with an open front surface. Typically, the main body encloses a refrigeration compartment and freezer, each with its own door. The refrigerator may include a plurality of drawers, shelves, vegetable compartments and the like for sorting and storing different types of items.

Conventionally, top mount type refrigerators were popular, with a freezer positioned at the upper side and a refrigeration compartment positioned at a lower side. Recently, the bottom freezer type refrigerators have been developed, where a freezer is located at the lower side and a refrigeration compartment is located at the top. Because typically users access the refrigeration compartment more often than the freezer, a bottom freezer type refrigerator allows a user to conveniently access the refrigeration compartment that is located at the upper portion of the refrigerator. Unfortunately, on the other hand, it can inconvenient for a user to access the freezer if a user often needs to lower or bend down to access the freezer, e.g., for taking ice out of the freezer.

Therefore, some bottom-freeze-type refrigerators are equipped with a dispenser for dispensing ice, e.g., ice cubes or crushed ice. The dispenser is typically located in a refrigeration compartment door. Accordingly, the ice-making device for producing ice may be installed in the refrigeration compartment door or the interior of the refrigeration compartment.

The ice-making device may include an ice tray configured to produce ice pieces and an ice storage part configured to store ice produced in the ice tray.

An ice tray according to the related art has a plurality of ice cells for containing water. Water is supplied to the ice cells through a water supply port. Water may be cooled in a cooling space in the ice-making device and become frozen, thereby turning into ice pieces.

The ice pieces produced in the ice cells of the ice tray may be discharged to the outside of the ice tray as an ice-releasing member is activated, e.g., rotated by a drive device such as a motor or the like.

A shaft is used to rotate the ice-releasing member. The location of the shaft generally constrains the location of the water supply port. The location of the water supply port is constrained to a position shifted at one side from a centerline of the ice tray. This poses a problem that water discharged from the water supply port is not concentrated but tends to stray toward a sidewall close to the water supply port, leading to poor water supply.

PRIOR ART DOCUMENTS

Patent Documents

Patent Document 1: Korean Patent Application Publication No. 10-2010-0065969 (published on Jun. 17, 2010)

SUMMARY

Embodiments of the present disclosure provide an ice-making device used in a refrigerator with improved water supply capability.

According to one embodiment of the present disclosure, an ice-making device for a refrigerator comprises: an upper frame; a lower frame coupled to the upper frame at a lower side thereof; an ice tray disposed in an internal space between the upper frame and the lower frame; a water supply port formed in a rear wall of the upper frame and configured to supply water to the ice tray; an upper sidewall protruding downward from an edge of an upper surface of the upper frame; a main water-blocking rib protruding from the rear wall and configured to primarily prevent the water supplied from the water supply port from straying along the upper sidewall; and an auxiliary water-blocking rib formed to protrude from the upper sidewall and configured to secondarily prevent the water supplied from the water supply port from straying along the upper sidewall.

The water supply port is formed at the opposite side of a centerline of the ice tray from a side at which ice pieces are released.

The ice tray may include ice cells partitioned by partition ribs, and the distance between the main water-blocking rib and the auxiliary water-blocking rib may equal to the width of an ice cell in the ice tray.

The ice-making device may further include an ice-storing unit configured to store ice pieces produced in the ice tray.

DETAILED DESCRIPTION

Figure 1:
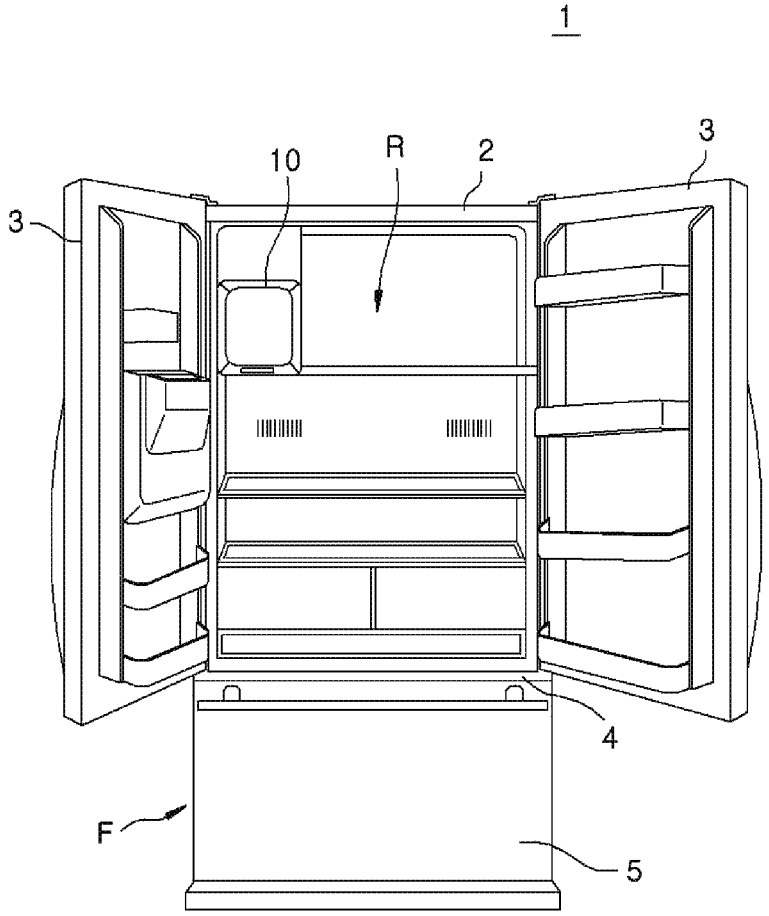
FIG. 1 is a perspective view illustrating the configuration of an exemplary refrigerator including an exemplary ice-making device according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is just exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, may include modifications for manufacturing.

Preferred embodiments of the present disclosure are described in detail with reference to the accompanying drawings.

FIG. 1 is a perspective view illustrating the configuration of an exemplary refrigerator including an exemplary ice-making device according to one embodiment of the present disclosure.

Referring to FIG. 1, the refrigerator 1 according to one embodiment of the present disclosure may include: a main body 2 serving as an outer body of the refrigerator and enclosing a storage space for food or other items; a barrier 4 configured to divide the storage space into an upper refrigeration compartment R and a lower freezer F; rotational refrigeration compartment doors 3 disposed at the opposite edges of a front surface of the main body 2 and configured to cover the refrigeration compartment R; and a freezer door 5 configured to cover the freezer F.

In the present embodiment, the ice-making device 10 is disposed at one side of an upper region of the refrigeration compartment R. However, this is merely exemplary. The ice-making device 10 may be installed in any other suitable location in the refrigeration compartment R. It may also be installed in the refrigeration compartment door 3 and the like.

An evaporator 8 is one of the components which perform a cooling cycle for generating cold air to maintain the refrigerator 1 at a low temperature. A typical cooling cycle of the refrigerator 1 may include the processes of compressing, condensing, expanding and evaporating a refrigerant. Cold air is generated as the cooling cycle is repeated.

More specifically, a gaseous refrigerant having a low temperature and a low pressure is compressed by the compressor 6 into a gaseous refrigerant having high temperature and high pressure. The gaseous refrigerant having high temperature and high pressure is condensed by a condenser 7 into a liquid refrigerant having high temperature and high pressure. The liquid refrigerant having high temperature and high pressure is expanded by an expander (not shown) into a liquid refrigerant having a low temperature and low pressure. Then, when the liquid refrigerant having low temperature and low pressure is fed to the evaporator 8, it is evaporated in the evaporator 8 by absorbing heat from ambient air. Thus, air surrounding the evaporator 8 is cooled and becomes cold air.

Since the surface temperature of the evaporator 8 is usually lower than the temperature of the refrigerator room, condensate water may be generated on the surface of the evaporator 8 in the course of heat exchange between the air circulating through the refrigerator room and the refrigerant. The condensate water may become frozen and adhere to the surface of the evaporator 8 as frost. As frost accumulates, the amount of heat that can be absorbed by the evaporator 8 is significantly reduced. This can cause heat exchange efficiency of the evaporator 8 to decrease.

To remove frost from the evaporator 8, a defrosting operation for melting the frost stuck to the evaporator 8 needs to be performed while the cooling process is stopped. A defrosting heater 9 may be disposed at the lower side of the evaporator 8. The defrosting heater 9 may be disposed at the lower side of the evaporator 8 and may heat the evaporator 8 to evaporate the frost.

Figure 2:
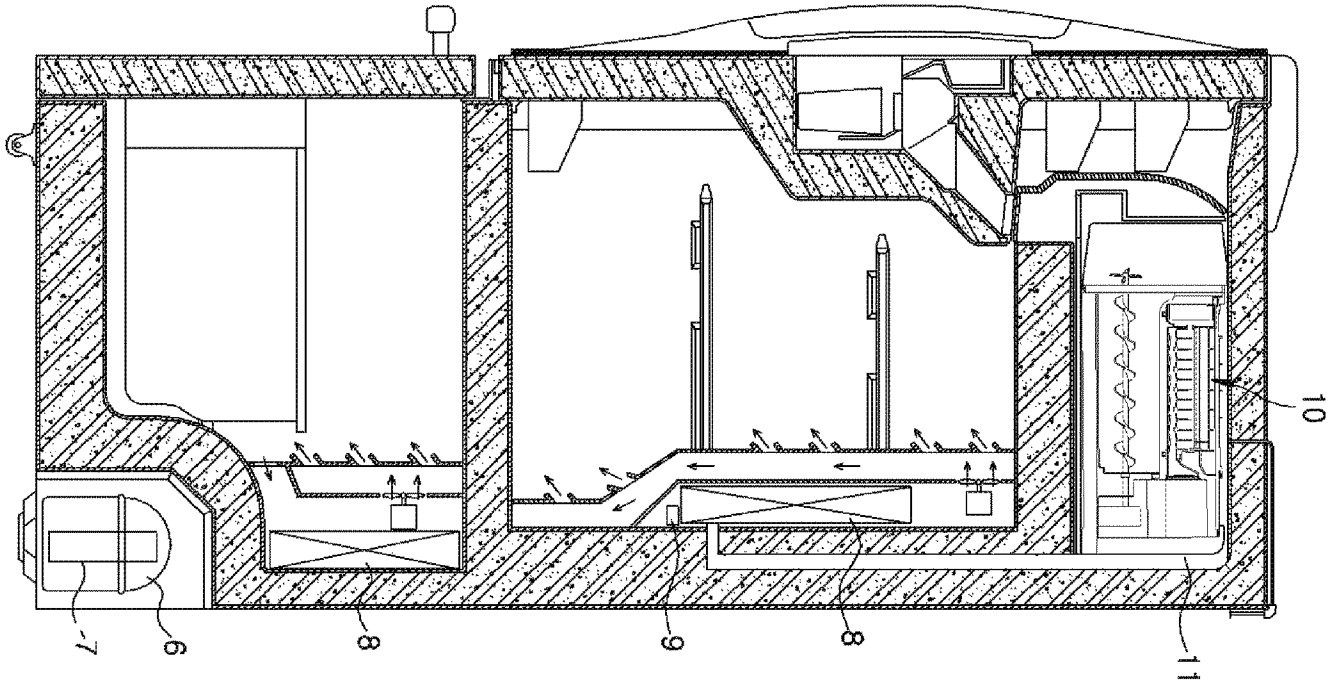
FIG. 2 is a side view illustrating the configuration of the exemplary refrigerator in FIG. 1.
Figure 3:
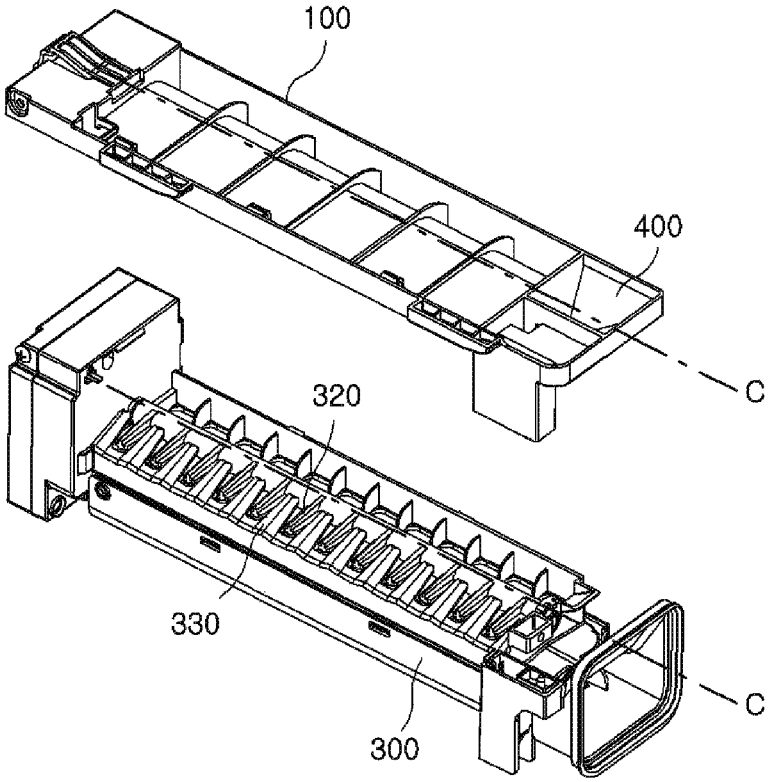
FIG. 3 is a perspective view illustrating the configuration of the exemplary ice-making device in the refrigerator in FIG. 1.
Figure 4:
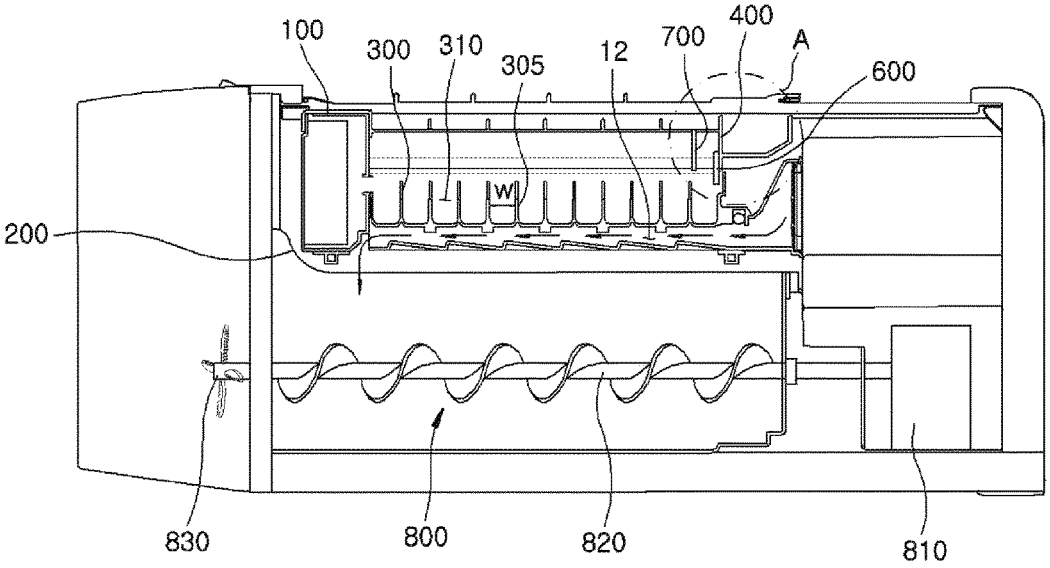
FIG. 4 is a side view illustrating the configuration of the exemplary ice-making device in the refrigerator illustrated in FIG. 1.
Figure 5:
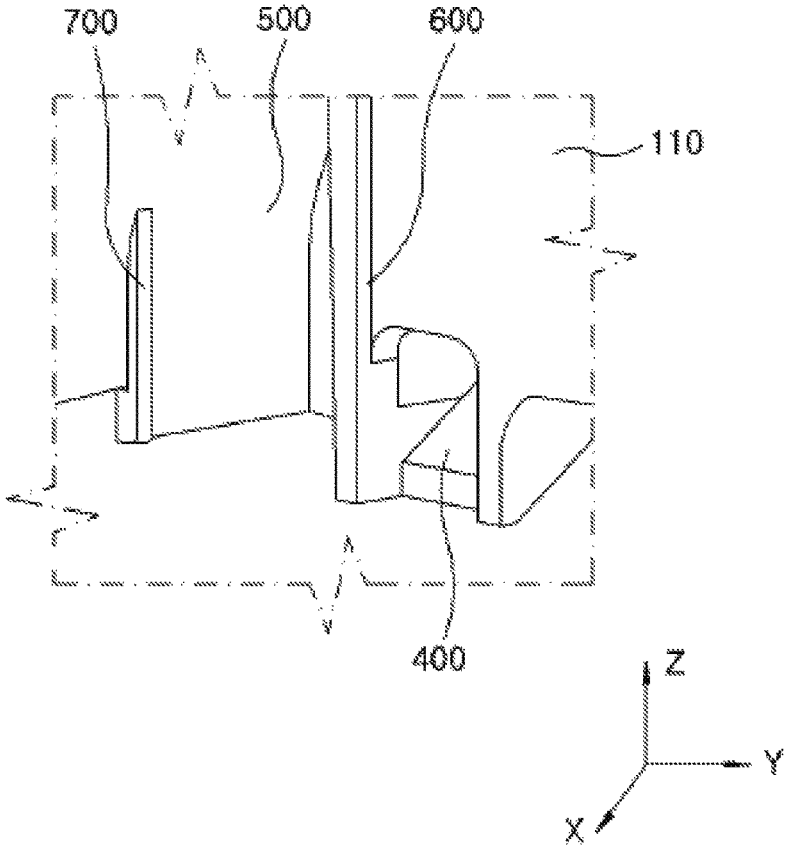
FIG. 5 illustrates an enlarged perspective view of a region designated by A in FIG. 4.

FIG. 2 is a side view illustrating the configuration of the exemplary refrigerator in FIG. 1. FIG. 3 is a perspective view illustrating the configuration of the exemplary ice-making device in the refrigerator in FIG. 1. FIG. 4 is a side view illustrating the configuration of the exemplary ice-making device in the refrigerator illustrated in FIG. 1. FIG. 5 illustrates an enlarged perspective view of a region designated by A in FIG. 4.

Referring to FIGS. 2 to 5, the ice-making device 10 for a refrigerator according to one embodiment of the present embodiment may produce ice pieces using cold air generated by the evaporator 8. As an example, in the bottom-freeze-type refrigerator in which the ice-making device 10 is installed in the refrigeration compartment door 3, cold air is discharged to the freezer F and the refrigeration compartment R in parallel. Cold air supplied to the freezer F flows toward the ice-making device 10 along a cold air duct 11 embedded in the sidewall of the main body 2 of the refrigerator 1. The cold air transforms the water into ice pieces while flowing through the ice-making device 10.

In the present embodiment, the ice-making device 10 is disposed at one side of an upper region of the refrigeration compartment R. However, this is merely exemplary. The ice-making device 10 may be installed in another suitable position of the refrigeration compartment R or may be installed elsewhere such as the refrigeration compartment door 3 and the like.

Referring again to FIGS. 2 to 5, the ice-making device 10 according to one embodiment of the present disclosure may include: an upper frame 100; a lower frame 200 coupled to the lower side of the upper frame 100; an ice tray 300 disposed in an internal space between the upper frame 100 and the lower frame 200; a water supply port 400 formed in a rear wall 110 of the upper frame 100 and configured to supply water to the ice tray 300; an upper sidewall 500 protruding downward from an edge of an upper surface of the upper frame 100; a main water-blocking rib 600 protruding from the rear wall 110 and configured to primarily prevent water supplied from the water supply port 400 from straying along the upper sidewall 500; and an auxiliary water-blocking rib 700 protruding from the upper sidewall 500 and configured to secondarily and further prevent water supplied from the water supply port 400 from straying along the upper sidewall 500.

The upper frame 100 and the lower frame 200 are coupled to each other to define an internal space between the upper frame 100 and the lower frame 200.

The ice tray 300 may be disposed in the internal space between the upper frame 100 and the lower frame 200 and may include ice cells 310 in which water can be transformed into ice pieces. The ice cells 310 may be partitioned by partition ribs 305 and may have different shapes. Any number of ice cells may be included in an ice tray according to the present disclosure.

The ice tray 300 may include an ice-releasing member 320 that can be rotated by a drive device such as a motor or the like. The ice-release member can discharge the ice pieces out the ice cells 310. An ice-releasing member guide 330 can guide the ice-releasing member 320.

The ice tray 300 may be made of metal having high heat conductivity, for example, aluminum. High heat conductivity of the ice tray 300 can facilitate heat exchange between the water in the ice tray 300 and cold air. Thus, the ice tray 300 may serve as a heat exchanger.

A cold air flow path 12 may be disposed at the lower side of the ice tray 300 so that the cold air supplied from the cold air duct 11 can be applied to the ice tray 300. The cold air may flow along the cold air flow path 12. Water accommodated within the ice cells 310 of the ice tray 300 turns into ice pieces due to heat exchange between cold air and the ice tray 300.

The ice pieces may be dropped onto an ice-storing unit 800 disposed under the ice tray 300. The ice pieces stored in the ice-storing unit 800 are moved toward an exit as a delivery member 820 is rotated by a drive device 810. The ice pieces moved toward the exit may be crushed into smaller pieces by a breaking member 830 and may be ejected to the outside via a dispenser.

The water supply port 400 may be formed in the rear wall 110 of the upper frame 100. Water may be supplied to the ice cells 310 of the ice tray 300 through the water supply port 400.

The water supply port 400 may be formed at the opposite side of the centerline C of the ice tray 300 from the side at which the ice pieces are released by the ice-releasing member 320.

More specifically, due to the existence of the shaft for rotating the ice-releasing member 320, the water supply port 400 needs to be disposed at the end of the centerline C of the ice tray 300. Since the upper frame 100 and the ice tray 300 are spaced apart from each other by a predetermined distance, water supplied from the water supply port 400 toward the ice tray 300 may flow outside the ice tray 300.

According to the conventional art, not all the water discharged from the water supply port 400 can be collected by the ice cells 310 of the ice tray 300. Rather, some water may stray toward the sidewalls next to the ice tray 300, e.g., the upper sidewall 500 and the sidewall of the ice tray 300. As a result, the water supply may be inefficient as some of the water can flow outside the ice cells 310 of the ice tray 300 (e.g., the cold air flow path 12). To prevent this problem, the main water-blocking rib 600 is configured as protruding from the rear wall 110.

The main water-blocking rib 600 may primarily prevent water supplied from the water supply port 400 from straying along the upper sidewall 500 and the sidewall of the ice tray 300.

The end of the main water-blocking rib 600 may protrude beyond the end of the water supply port 400. In this regard, the end of the main water-blocking rib 600 and the end of the water supply port 400 refer to the ends protruding forward in the X-axis direction in FIG. 5. Consequently, water supplied from the water supply port 400 encounters the main water-blocking rib 600 prior to straying toward the rear wall 110. Thus the main water-blocking rib 600 can primarily prevent water from straying toward the rear wall 110.

The main water-blocking rib 600 may be integrally formed with the rear wall 110. However, this is merely exemplary. The main water-blocking rib 600 may be a separate component manufactured and may be mounted to the rear wall 110 during assembling.

However, the main water-blocking rib 600 can only protrude from the rear wall 110 to a certain extent. Thus, even if the main water-blocking rib 600 is installed in the rear wall 110, some water discharged from the water supply port 400 may flow over the main water-blocking rib 600 and may be dispersed outside the ice tray 300.

The auxiliary water-blocking rib 700 is installed in the upper sidewall 500. In this regard, the upper sidewall 500 refers to a sidewall extending downward from the opposite edge of the upper surface of the upper frame 100 from the side at which the ice pieces are released.

In other words, the upper sidewall 500 is disposed outside the sidewall of the ice tray 300. Thus, the upper sidewall 500 may serve as a water-blocking wall which further prevents water supplied from the water supply port 400 from straying toward the sidewall of the ice tray 300. In this configuration, water supplied from the water supply port 400 can be substantially or entirely contained in the ice cells 310.

The auxiliary water-blocking rib 700 may protrude from the upper sidewall 500. Thus, the auxiliary water-blocking rib 700 may secondarily and further prevent water supplied from the water supply port 400 from straying toward the upper sidewall 500 and the sidewall of the ice tray 300.

In some embodiments, the main water-blocking rib 600 and the auxiliary water-blocking rib 700 lie on one extension line extending in the X-axis direction in FIG. 5. The distance between the main water-blocking rib 600 and the auxiliary water-blocking rib 700 may equal to the width W of an ice cell 310 of the ice tray 300.

The auxiliary water-blocking rib 700 may be integrally formed with the upper sidewall 500. However, the present disclosure is not limited thereto. The auxiliary water-blocking rib 700 may be separately manufactured and mounted to the upper sidewall 500 during assemble.

The operations and functions of the exemplary ice-making device 10 for a refrigerator are described herein.

Water is supplied to the ice cells 310 of the ice tray 300 through the water supply port 400 disposed in the rear wall 110 of the upper frame 100.

In the course of supplying the water to the ice cells 310, water discharged from the water supply port 400 first encounters the main water-blocking rib 600.

The main water-blocking rib 600, which protrudes from the rear wall 110 of the upper frame 100, prevents water discharged from the water supply port 400 from straying along the upper sidewall 500 and the sidewall of the ice tray 300 due to surface tension.

If the main water-blocking rib 600 is not installed in the rear wall 110 of the upper frame 100, water discharged from the water supply port 400 may leak to the upper sidewall 500 and the sidewall of the ice tray 300. In this case, the amount of water supplied to the ice cells 310 of the ice tray 300 may vary depending on the ice cells 310. Thus, the size of ice pieces produced in the ice cells 310 may not be uniform. Furthermore, if water leakage occurs in the ice pieces produced in the ice cells 310, the ice pieces may be caught in the process of releasing the ice pieces and may not be smoothly released. In addition, if water leakage occurs in the cold air flow path 12, leaked water can become frozen in the cold air flow path 12. Thus, the cold air flow path 12 may be clogged, consequently obstructing circulation of cold air through the refrigerator 1.

To solve this problem, in the ice-making device 10 according to one embodiment of the present disclosure, the main water-blocking rib 600 is installed in the rear wall 110 of the upper frame 100 and the auxiliary water-blocking rib 700 is installed in the upper sidewall 500. This can prevent water discharged from the water supply port 400 from leaking outside of the ice cells 310 of the ice tray 300, such as the upper sidewall 500, the sidewall of the ice tray 300 and the like. As a result, the amount of water contained in each ice cells 310 is advantageously uniform. This enables the ice-making device 10 to produce ice pieces having uniform size.

Furthermore, this configuration can prevent the ice pieces from being caught when the ice pieces are released from the ice tray 300. It can also reduce or prevent clogging of the cold air flow path.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. An ice-making device for a refrigerator, the ice-making device comprising:

an upper frame;

a lower frame coupled to the upper frame at a lower side thereof;

an ice tray disposed between the upper frame and the lower frame;

a water supply port formed in a rear wall of the upper frame and configured to supply water to the ice tray, the water supply port being opened in a lengthwise direction of the ice tray;

an upper sidewall protruding downward from an edge of an upper surface of the upper frame; and a first water-blocking rib protruding from the rear wall along the lengthwise direction of the ice tray, wherein an end of the first water-blocking rib protrudes beyond an end of the water supply port along the lengthwise direction of the ice tray.

2. The ice-making device of claim 1, wherein the first water-blocking rib is configured to prevent the water supplied from the water supply port from straying along the upper wall.

3. The ice-making device of claim 1, further comprising a second water-blocking rib protruding from the upper sidewall.

4. The ice-making device of claim 3, wherein the second water-blocking rib is configured to prevent the water supplied from the water supply port from straying along the upper sidewall.

5. The ice-making device of claim 1, wherein the water supply port is disposed at an opposite side with respect to a centerline of the ice tray to a side at which ice pieces are released.

6. The ice-making device of claim 3, wherein the ice tray comprises partition ribs and wherein ice cells are partitioned by the partition ribs, and wherein a distance between the first water-blocking rib and the second water-blocking rib equals to a width of an ice cell of the ice tray.

7. The ice-making device of claim 1, further comprising an ice-storing unit configured to store ice pieces produced in the ice tray.

8. An ice-making device for a refrigerator, the ice-making device comprising:

an upper frame;

a lower frame coupled to the upper frame at a lower side thereof;

an ice tray disposed between the upper frame and the lower frame;

a water supply port disposed in a rear wall of the upper frame and configured to supply water to the ice tray, the water supply port being opened in a lengthwise direction of the ice tray;

a water-blocking rib formed to protrude from the rear wall; and an upper side wall extending downward from an opposite edge of an upper surface of the upper frame, wherein ice pieces are released at a location proximate to the upper side wall, wherein the upper side wall is disposed outside a sidewall of the ice tray and operable to prevent water supplied from the water supply port from straying along the sidewall of the ice tray, wherein an end of the first water-blocking rib protrudes beyond an end of the water supply port along the lengthwise direction of the ice tray.

9. A refrigerator comprising:

a first body enclosing storage spaces; and an ice-making device comprising:

an upper frame;

a lower frame coupled to the upper frame at a lower side thereof;

an ice tray disposed in an internal space between the upper frame and the lower frame;

a water supply port formed in a rear wall of the upper frame and configured to supply water to the ice tray, the water supply port being opened in a lengthwise direction of the ice tray;

an upper sidewall protruding downward from an edge of an upper surface of the upper frame; and a first water-blocking rib protruding from the rear wall along the length direction of the ice tray, wherein an end of the first water-blocking rib protrudes beyond an end of the water supply port along the lengthwise direction of the ice tray.

10. The refrigerator of claim 9, wherein the first water-blocking rib is configured to prevent water supplied from the water supply port from straying outside the ice tray.

11. The refrigerator of claim 10, wherein the ice-making device further comprises a second water-blocking rib protruding from the upper sidewall.

12. The refrigerator of claim 11, wherein the second water-blocking rib is configured to further prevent water supplied from the water supply port from straying outside the ice tray.

13. The refrigerator of claim 9, wherein the water supply port is disposed at an opposite side with respect to a centerline of the ice tray to a side at which ice pieces are released.

14. The refrigerator of claim 12, wherein the ice tray comprises partition ribs, wherein the ice cells are partitioned by the partition ribs, and wherein a distance between the first water-blocking rib and the second water-blocking rib equals to a width of an ice cells in the ice tray.

15. The refrigerator of claim 9, wherein the ice-making device further comprises an ice-storing unit configured to store ice pieces produced in the ice tray.

* * * * *